US009388571B2

(12) United States Patent
Brown et al.

(10) Patent No.: US 9,388,571 B2
(45) Date of Patent: Jul. 12, 2016

(54) STONE FABRICATION SYSTEM WITH HIDDEN MORTAR JOINT

(76) Inventors: Dustin A. Brown, Knoxville, TN (US); Robert Brown, Knoxville, TN (US)

( * ) Notice: Subject to any disclaimer, the term of this patent is extended or adjusted under 35 U.S.C. 154(b) by 287 days.

(21) Appl. No.: 12/275,486

(22) Filed: Nov. 21, 2008

(65) Prior Publication Data

US 2009/0126301 A1 May 21, 2009

Related U.S. Application Data

(60) Provisional application No. 60/989,640, filed on Nov. 21, 2007.

(51) Int. Cl.

| | |
|---|---|
| ***E04B 2/04*** | (2006.01) |
| ***B44F 9/04*** | (2006.01) |
| *E04B 2/02* | (2006.01) |

(52) U.S. Cl.

CPC ... *E04B 2/04* (2013.01); *B44F 9/04* (2013.01); *E04B 2002/0267* (2013.01); *E04B 2002/0271* (2013.01)

(58) Field of Classification Search

CPC ..... E04B 2/04; E04B 2002/0267; E04B 2002/0271; B44F 9/04; E04C 1/395

USPC ..... 52/315, 575, 598, 314, 605, 606, 604, 52/608, 612, 742.16, 742.1, 742.13, 52/742.14, 745.05, 745.09, 745.1, 747.12

See application file for complete search history.

(56) References Cited

U.S. PATENT DOCUMENTS

| | | | | |
|---|---|---|---|---|
| 1,419,805 | A * | 6/1922 | Bigler | 52/436 |
| 1,681,028 | A * | 8/1928 | Chapin | 52/100 |
| 1,789,099 | A * | 1/1931 | Fusco et al. | 52/314 |
| 2,243,069 | A * | 5/1941 | Brown | 52/605 |
| 2,305,280 | A * | 12/1942 | Strunk et al. | 52/276 |
| 3,936,989 | A * | 2/1976 | Hancock | 52/592.6 |
| 4,229,123 | A * | 10/1980 | Heinzmann | 405/273 |
| 4,665,673 | A * | 5/1987 | Diana | 52/314 |
| 5,791,827 | A * | 8/1998 | Arvai et al. | 405/286 |
| 5,802,797 | A | 9/1998 | Storer-Folt | |
| 6,371,700 | B1 * | 4/2002 | Rich | 405/284 |
| 6,539,684 | B1 * | 4/2003 | Graham | 52/609 |
| 6,616,382 | B2 * | 9/2003 | Woolford et al. | 405/284 |
| 6,682,269 | B2 * | 1/2004 | Price et al. | 405/284 |
| 7,208,112 | B2 | 4/2007 | Scherer | |
| 2003/0126821 | A1 * | 7/2003 | Scherer et al. | 52/604 |
| 2004/0006943 | A1 | 1/2004 | Weick | |
| 2006/0110223 | A1 * | 5/2006 | Dawson et al. | 405/286 |
| 2008/0110116 | A1 | 5/2008 | Brown et al. | |

FOREIGN PATENT DOCUMENTS

| | | | |
|---|---|---|---|
| KR | 1982-0000437 | Y1 | 3/1982 |
| KR | 10-2004-0049657 | A | 6/2004 |

* cited by examiner

*Primary Examiner* — Joshua J Michener
*Assistant Examiner* — Theodore Adamos
(74) *Attorney, Agent, or Firm* — Luedeka Neely Group, PC

(57) ABSTRACT

A manufactured stone block for use in building a structure having a front surface with a simulated natural stone appearance. A portion of an upper surface of the block includes a recessed mortar joint for a user to place mortar therein to secure the manufactured stone block to an adjacent surface.

14 Claims, 10 Drawing Sheets

STONE FABRICATION SYSTEM WITH HIDDEN MORTAR JOINT

RELATED APPLICATIONS

This application claims priority under 35 U.S.C. §119(e) to U.S. provisional application Ser. No. 60/989,640, filed Nov. 21, 2007.

FIELD

This invention relates to the field of building materials. More particularly, this invention relates to manufactured stone building systems.

BACKGROUND AND SUMMARY

Conventional bricks, also called compressed earth blocks (CEBs), in use today are typically ceramic blocks made of kiln-fired materials, such as clay. On a small scale, clay bricks are formed in a mold, which is called the soft mud method, and on a large, commercial scale, clay bricks are made by extruding clay through a die and wire-cutting the bricks, which is called the stiff mud process. Sometimes the clay is mixed with water and these dampened clay bricks are subjected to high pressures. Such bricks are highly resistant to weathering and therefore well-suited for construction of exterior walls. The shaped clay is dried and fired to achieve the final brick shape with the desired strength. The firing process is usually done by a continuously fired kiln, in which the bricks move slowly through the firing on a conveyor belt or the like. This enables production of an essentially indefinite number of bricks which exhibit consistent physical characteristics.

Other types of building materials are sometimes used for wall construction, including wood, vinyl, stucco, and/or stones. For many years stones or natural rocks were thought by many in the building trade to be superior to bricks both functionally and aesthetically. However, stones for use in wall construction are typically heavier than bricks and must normally be sculpted into the proper shape. Some prefer stone walls because the stones are shaped and colored more naturally and randomly, and provide less of an "assembly-line" look, and more aesthetically pleasing look. However, using such irregular shapes in construction of a wall introduces difficulties in addition to regular building considerations. For example, irregular shapes may require individual stones to be broken/sculpted in order to finish the corner or side of a wall or to fit with other stones in the construction of a wall. However, this is very difficult, time-consuming, and wasteful because stones and rocks tend to break and crack irregularly. For this and other reasons, the commercial success of "natural" stone walls remains limited, despite their aesthetic, functional, and other advantages.

Attempts have been made to produce manufactured stone walls which do not require the use of sculpted or reshaped stones. Such attempts have included cast stone "tiles" which are cast from aggregate and/or ground stone and are plastered to the sides of a building to provide the illusion of natural stone walls. However, such stone tiles are not easily used in conjunction with conventional bricks.

A recent trend in home building involves the use of varying external materials to build a single wall, such as areas of brick and areas of wood paneling, all on one wall surface. However, until recently, there was no known method of effectively combining bricks and stones in the production of a wall. The regularity of bricks and the irregularity of stones makes it very difficult to integrate the two into a single wall structure, even with the use of the aforementioned manufactured stone tiles. Unlike stone tiles, conventional bricks are laid on top of each other a certain distance from the side of a building to create a wall. The space between bricks and the side of a building has the advantage of acting as an insulating space. Such a space is not possible with stone tiles, which are plastered to the side of a building. Additionally, the stone tiles may not be easily used in conjunction with bricks in building a structure, since the distance the stone tiles extend from a structure is much less than the distance bricks extend from a structure, creating aesthetic and structural problems.

Some of the problems faced with manufactured stone tiles are addressed in Applicants' U.S. Patent Application Publication No. 2008/0110116, which is incorporated herein by reference. The '116 publication describes a system of manufactured stone blocks which have at least one surface with a simulated-stone appearance and having a length, a height, and a depth determined based on a compatibility factor derived from the length, height, and depth of a conventional brick and the width of the mortar joint located between conventional bricks. The compatibility factor is used to derive a dimension equation for the length, height, and depth and the dimension equations are used to fabricate the manufactured stone blocks.

The manufactured stone blocks of the '116 publication enjoy many of the benefits of conventional bricks, such as having a space between the manufactured stone block wall and the side of the building to act as an insulating space, while also providing the appearance of a "natural" stone wall. Additionally, the stone blocks are dimensionally compatible with conventional bricks and manufactured stone block sections may be easily interspersed into a brick wall. Further, masons do not need to undergo substantial amounts of training to learn the method of building structures out of the manufactured stone blocks, since they are laid in a similar manner to conventional bricks with mortar and typical mortar joints, unlike stone tiles which required a mason to learn a new method of building a structure.

However, the manufactured stone blocks of the '116 publication may not be sufficient to simulate the appearance of all natural stone walls. For example, as shown in FIGS. 1 & 2, some natural stone structures are built in a "dry-stack" construction without the use of mortar or grout in visible joints as found in brick walls. However, the mortar and grout joints are desirable to hold the blocks together and add strength to the walls. Accordingly, there is a need for a manufactured stone block which enjoys the benefits described in the '116 publication and utilizes the strength advantages offered by mortar joints between stone blocks, while also simulating the appearance of a dry-stack stone wall. Additionally, some forms of natural stone construction are not amenable to the rectangular block form disclosed in the '116 publication. For example, as shown in FIG. 2, in ledgestone walls and other types of rock walls it is often desirable to use stones which are not uniformly rectangular. Accordingly, there is also a need for a manufactured stone block system which enjoys the ease of use of the manufactured stone system of the '116 publication, while also maintaining the often desired aesthetic appearance of irregularly, non-rectangular shaped rocks.

These needs are addressed by the stone fabrication system of the present invention. A hidden mortar joint is included in the manufactured stone blocks which is not visible on the external face of the brick including the natural stone appearance in order to provide the appearance of a dry-stack wall, while also providing a joint for application of mortar or grout to hold the manufactured stone in place and provide strength to the wall. Additionally, multiple simulated stone portions may be molded into the externally facing side of the manufactured stone block, thereby providing the dimensional compatibility advantages described in the '116 publication while also providing the appearance of irregularly shaped stones.

BRIEF DESCRIPTION OF THE DRAWINGS

Further advantages of the invention will become known by reference to the detailed description when considered in conjunction with the figures, which are not to scale so as to more clearly show certain details, wherein like reference numbers indicate like elements throughout the several views, and wherein.

DETAILED DESCRIPTION

Referring now to FIGS. 3-6, a manufactured stone block 22 according to one embodiment of the present invention is shown. The manufactured stone block 22 is preferably substantially solid and, in various embodiments, has a weight substantially similar to natural stone. However, in alternate embodiments, the block 22 may have hollow portions therein. Crushed stone or an aggregate mixture, or other material suitable for creating simulated-stone blocks, are preferably used to create the manufactured stone blocks 22. An aggregate stone block has pieces of stone dispersed throughout the body of the aggregate stone block. These pieces of stone are irregular in shape and are dispersed throughout the aggregate stone block in varying consistencies. Although the finished exterior surfaces of aggregate stone blocks are generally smooth, having the simulated appearance of natural stone, the aggregate is visible if the block is chipped. The coloration, texture, shape, and many other characteristics of the finished face differ greatly from those of the chipped surface. Thus, although either aggregate or crushed stone may be used for the present invention, aggregate stone blocks are less desirable than crushed stone blocks, which have a substantially constant coloration and texture throughout. In alternate embodiments, only a portion of the manufactured stone block 22 may be formed of crushed stone, aggregate, or similar materials, for example the front portion of the block, and other portions of the manufactured stone block, such as the rear portion, may be made of alternate materials, such as polymeric material, concrete, or other suitable materials and the two portions of the manufactured stone block may be joined together by suitable adhesives or attachment mechanisms.

Figure 3:
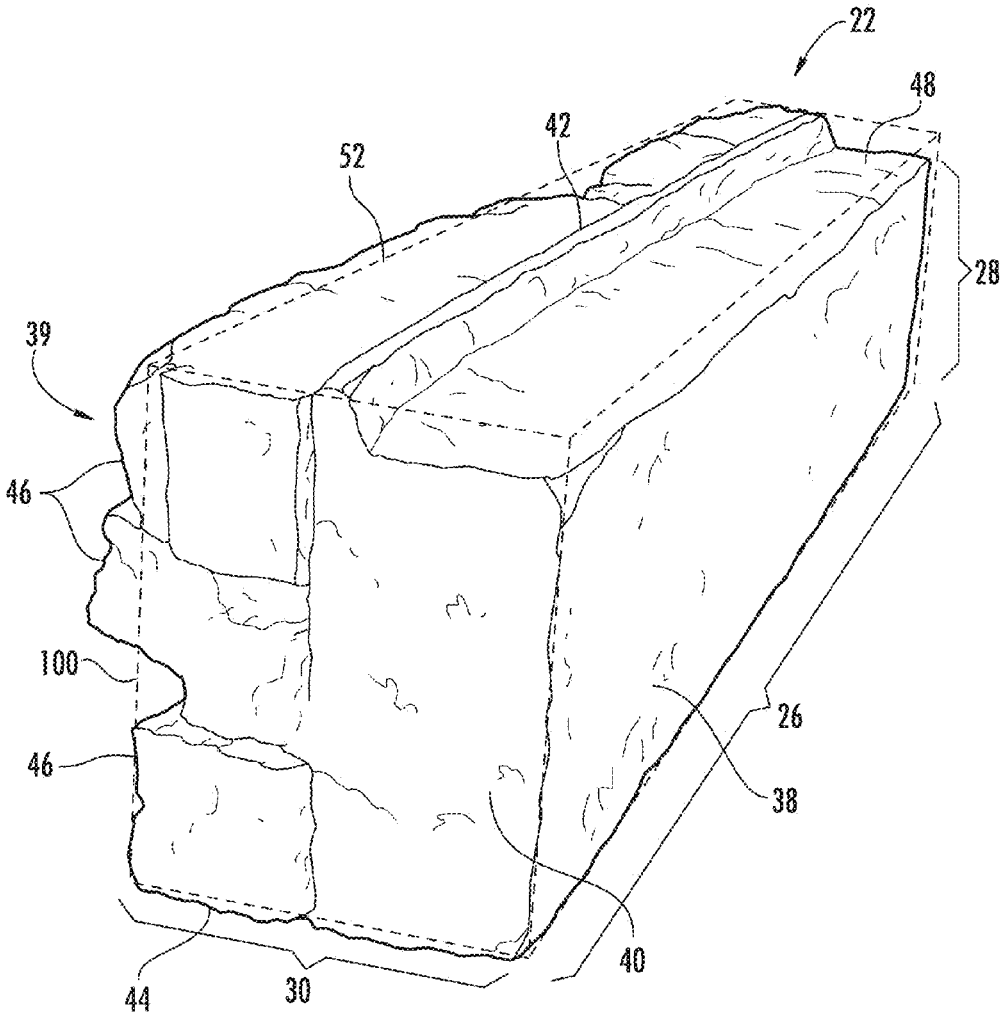
FIGS. 3 & 4 show perspective views of a manufactured stone block according to a first embodiment of the invention.
Figure 4:
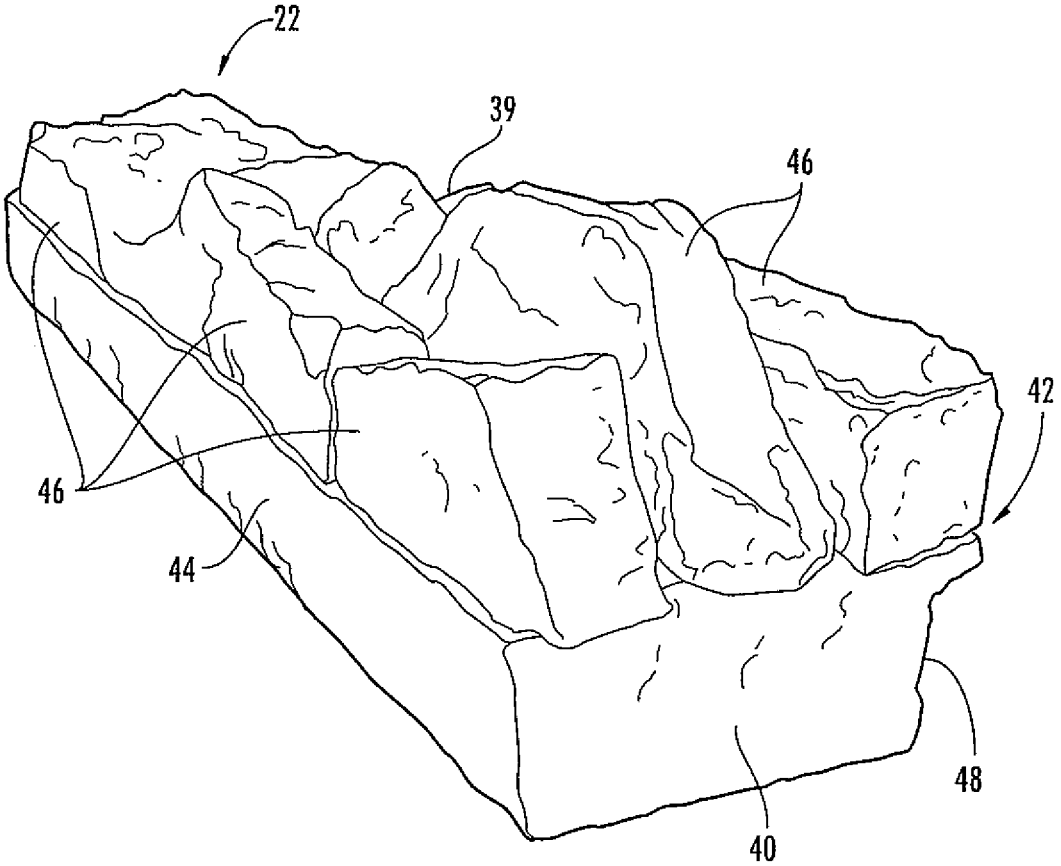
Figure 5:
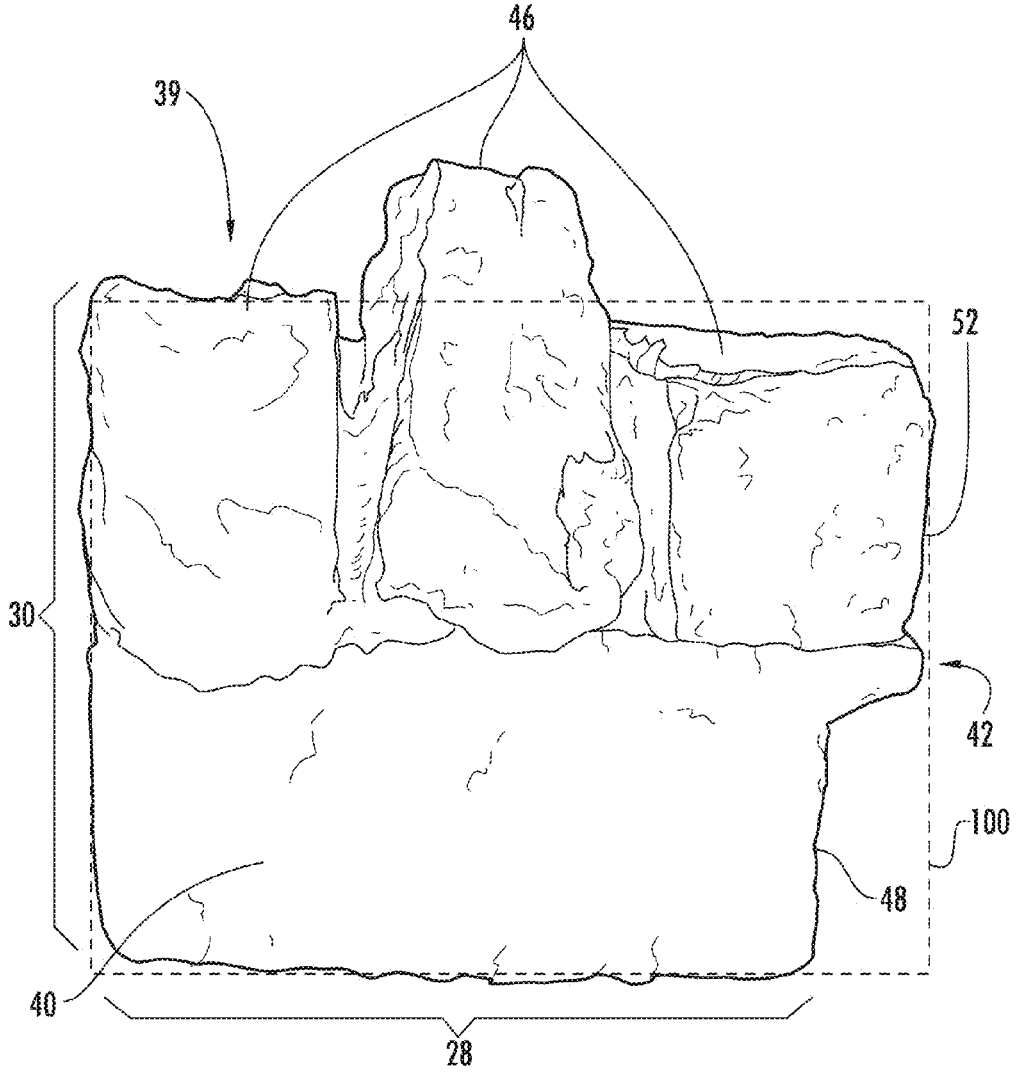
FIG. 5 is a side view of a manufactured stone block according to the first embodiment of the invention.
Figure 6:
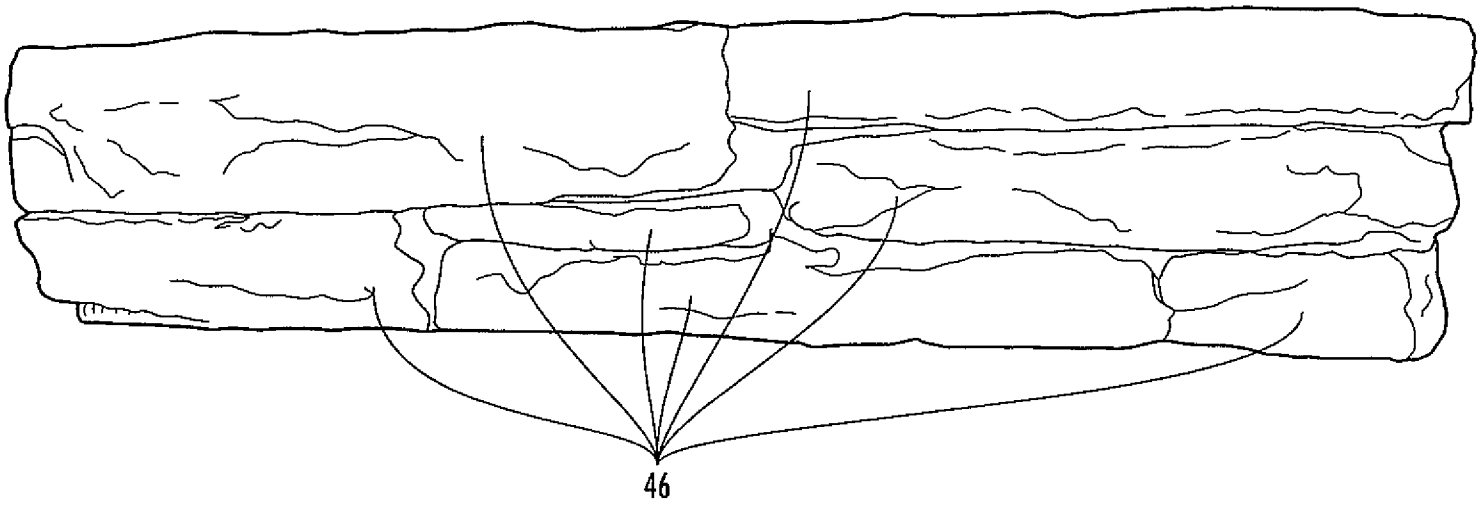
FIG. 6 is a front view of a manufactured stone block according to the first embodiment of the invention.

The manufactured stone block 22 preferable has a generally parallelpiped configuration. For example, in one embodiment shown in FIGS. 3 and 5, the blocks are generally defined by an imaginary parallelepiped projection 100. The length 26 of the manufactured stone block 22 is typically the longest of the three dimensions. The length, along with the height 28, define a front face 39 and rear face 38 of the block 22. The depth 30 and the height 28 define two side faces 40 of the block 22. Finally, the length 26 and the depth 30 define upper 42 and lower faces 44 of the block 22. The two side faces 40 typically have substantially the same dimensions and the rear portion thereof has a substantially smooth, unfinished appearance, except in certain instances such as when a block is used to create a corner. The upper and lower faces 42 and 44 also typically have substantially smooth, unfinished surfaces on the rear portions thereof. However, unlike the rear face, which is typically substantially smooth and unfinished, the front face 39 preferably includes at least one molded stone feature 46 and in many embodiments includes multiple molded stone features 46. These stone features may also extend back from the front face, as shown in FIGS. 3-5, such that at least a front portion 52 of the top, side, and bottom faces include molded stone features. In certain embodiments, the front face 39 is generally rectangular or square with the top and bottom substantially parallel and the sides substantially parallel. However, in certain embodiments surfaces of the front face may be at least somewhat unparallel, such as the sides of the front surface shown in FIG. 6, in order to provide a wall with a more random appearance similar to standard stone walls. In further alternate embodiments, any desired polygonal shape could be used.

Also, the blocks 22 could have any desired dimensions. In one embodiment of the invention, the blocks 22 are provided with substantially uniform overall dimensions to allow for case of construction In another embodiment of the invention, the length 26, depth 30, and the height 28 are based on compatibility factors, similar to the manufactured stone blocks described in the '116 publication. The compatibility factors allow the manufacturer of the manufactured stone blocks 22 to fabricate numerous shapes and sizes of manufactured stone blocks 22 that may be used in conjunction with one another and in conjunction with other types of building materials to build a structure. The dimensions of the manufactured stone blocks 22 are proportional so that various sizes of manufactured stone blocks 22 may be used in conjunction to build a structure. The compatibility factors are preferably determined based on the dimensions of a conventional brick, or compressed earth block ("CEB"). The dimensions of a compressed earth block in the United States typically include a length of about eight (8) inches, a height of about two and one quarter (2.25) inches, and a depth of about four (4) inches. Additionally, the typical mortar joint is about ¼ inches thick. Thus, the manufactured stone blocks 22 according to the present invention may have a compatibility factor for the length 26 of 8 inches in a preferred embodiment. The compatibility factor for the height 28 of the front face 39 of the block may be 2.5 inches (the typical height of a CEB plus the typical width of a mortar joint). The compatibility factor for the depth 30 may be four (4) inches but remains constant, that is, the manufactured stones 22 are preferably manufactured with dimensions at multiples of the compatibility factors for length 26 and height 28, but typically have a substantially constant depth 30, which is substantially equal to the depth 30 of a compressed earth block. One motivation and advantage behind sizing manufactured stone blocks 22 based on their CEB counterparts is that the manufactured stone blocks 22 and the CEBs may be easily used in conjunction if their shapes are proportional.

Figure 7A:
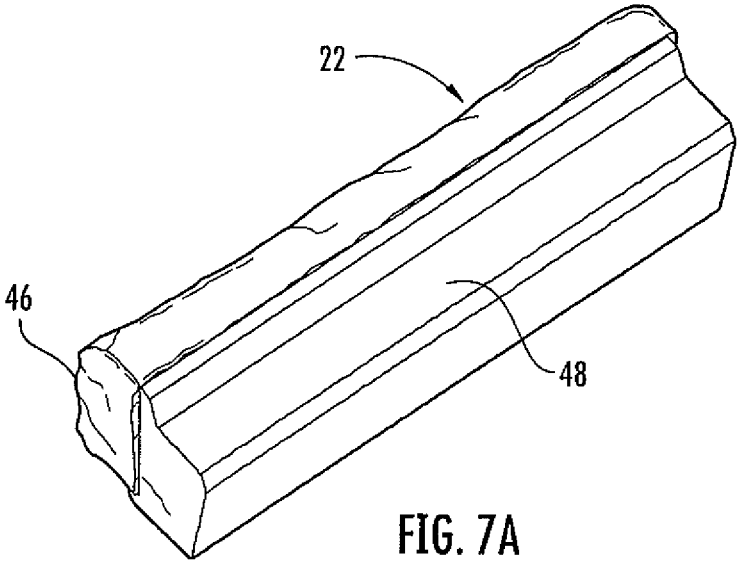
FIG. 7A is a perspective view of a manufactured stone block according to a second embodiment of the invention.
Figure 7B:
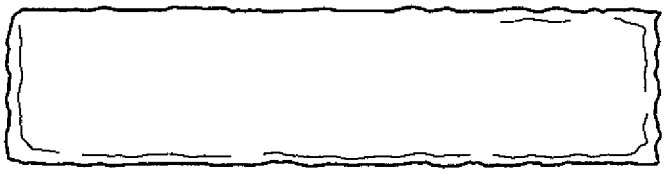
FIG. 7B is a front view of a manufactured stone block according to the second embodiment of the invention.

In the embodiment shown in FIGS. 3-6, molded stone features 46 on the front face 39 of the blocks 22 simulate projecting portions of multiple, individual stones. As shown, these individual stone features may have different lengths and heights and be irregularly spaced throughout the block to provide a random appearance similar to natural stones used in typical stone wall construction. However, in other embodiments, such as shown in FIGS. 7A and 7B, the manufactured stone blocks 22 may have a front face 39 with a single simulated stone feature, similar to the manufactured stone blocks described in the '116 publication, or various simulated stone features. In further alternate embodiments of the invention, ornamental features other than simulated stone may be located on the front face of the blocks 22.

In a preferred embodiment of the invention, a hidden mortar joint 48 is located on a portion of the upper face 42 of the manufactured stone block 22. The hidden mortar joint 48 allows for construction of a wall with a simulated stone, dry-stack appearance, while also having the advantages of the strength provided by mortar between adjacent blocks. In one embodiment, the hidden mortar joint 48 is a recessed portion of the upper face, extending the length of the manufactured stone block and typically extending about 2 to 3 inches from the rear face 38 towards the front face 39. The hidden mortar joint is recessed downward from the upper face about ¼ to ½ inches. However, in other embodiments, the hidden mortar joint 48 may have various suitable dimensions and be located at various positions of the upper face. For example, the hidden mortar joint 48 may not extend the entire length of the upper face, but may only extend along a portion of the length or may be intermittently formed along the length.

Figure 9A:
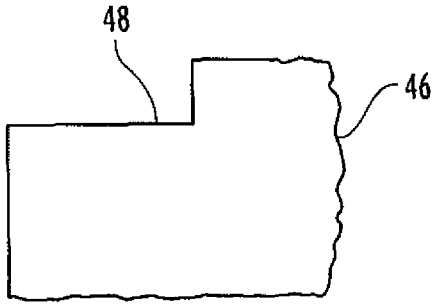
FIGS. 9A-9F are side views of manufactured stone blocks showing variously configured hidden mortar joints according to various embodiment of the invention.
Figure 9B:
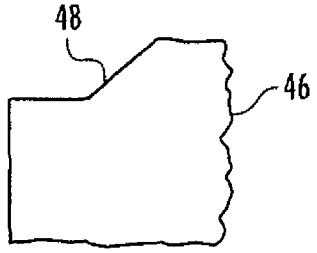
Figure 9C:
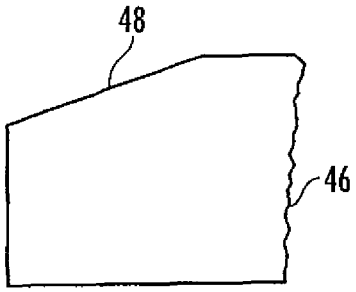
Figure 9D:
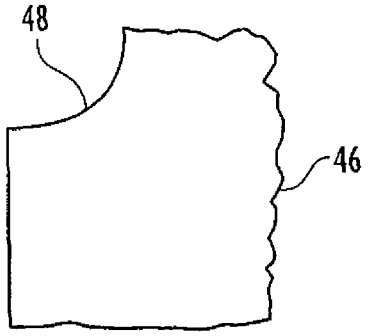

The hidden mortar joint may have various configurations. In one embodiment, as shown in FIG. 9A, the joint is a recessed ledge extending down from a mid-portion of the top face and substantially perpendicularly towards the rear. However, in alternate embodiments, such as shown in FIGS. 9B-9D, the hidden mortar joint may have a sloped configuration (FIG. 9C), a hybrid configuration (FIG. 9B), an arc configuration (FIG. 9D), or any other suitable configuration to hold sufficient mortar to provide strength to a wall formed from such blocks.

Figure 9E:
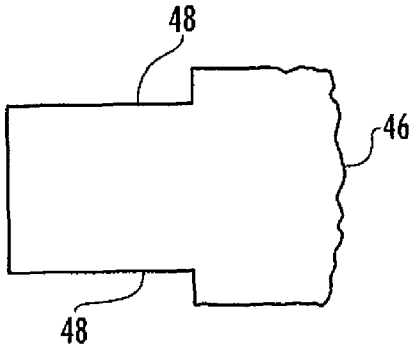
Figure 9F:
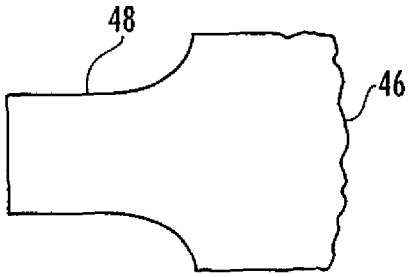

In a preferred embodiment, as shown in FIGS. 3-6, the sides of adjacent blocks may not have hidden mortar joints, with no mortar there between. However, in alternate embodiments of the invention, a hidden mortar joint may also be located on at least one side wall and/or mortar may be placed substantially between the sides of adjacent block. In certain embodiments, the bottom face of the block may include the hidden mortar joint, rather than the top. In further embodiments, as shown in FIGS. 9E & 9F, the top face and bottom face of the manufactured stone block may both have a hidden mortar joint. In such an embodiment, each mortar joint may have less depth than the depth of the mortar joint appearing on a block with the mortar joint only on the top surface.

Figure 8A:
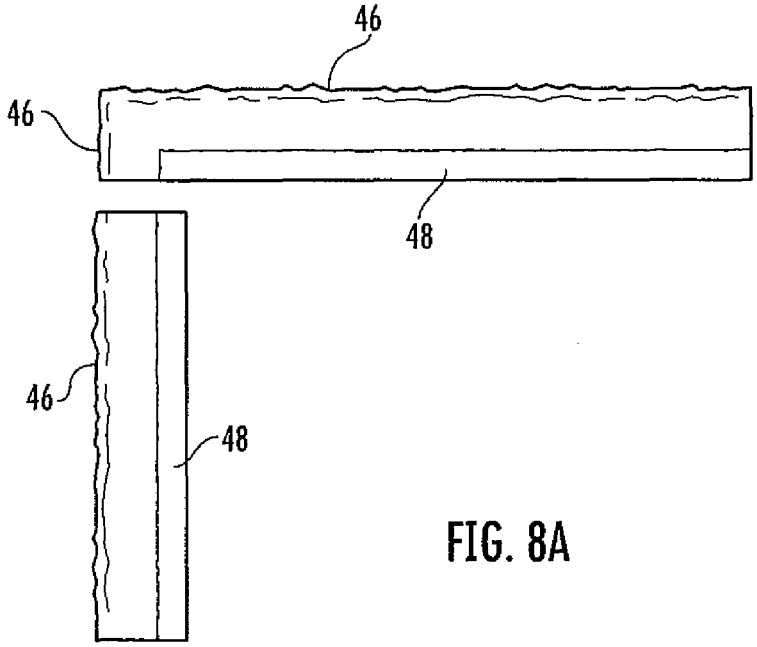
FIG. 8A is a top view of manufactured stone block used for building walls with two surfaces meeting at a corner according to an embodiment of the invention.
Figure 8B:
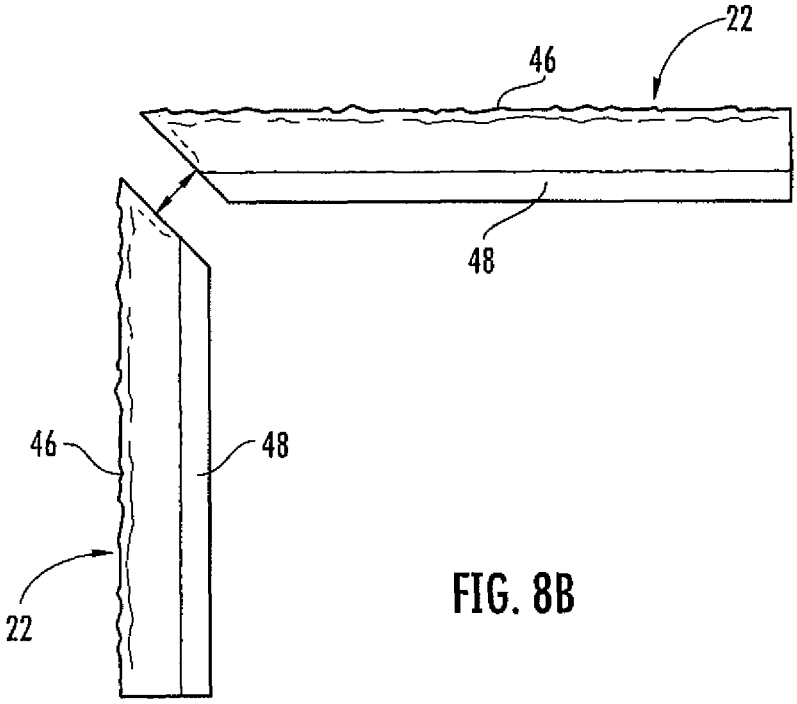
FIG. 8B is a top view of manufactured stone block used for building walls with two surfaces meeting at a corner according to another embodiment of the invention.

Additionally, certain manufactured stone blocks may have embodiments with different overall dimensions or different face features. For example, as shown in FIG. 8A, blocks for use with corners of structures may have stone features 46 on multiple faces, such as the front face 39 and one or more side faces 40, and the hidden mortar joint may not extend the entire length of the block. In other embodiments of blocks 22 used for wall corners, as shown in FIG. 8B, the side walls of adjacent blocks may angle from the front face 39 to the rear face 38 at an angle, such as 45°, to provide for a corner when the blocks are placed adjacent to each other.

In additional alternate embodiments, the hidden mortar joint may be a recess that is not adjacent the rear portion of the top face of the block, but may be located in a mid portion of the top and/or bottom face. In such an embodiment, the front face 39 and rear face 38 of the block 22 may both have molded stone features. This could be potentially useful when building free-standing walls, rather than walls wherein the rear face would not typically be seen.

Figure 1:
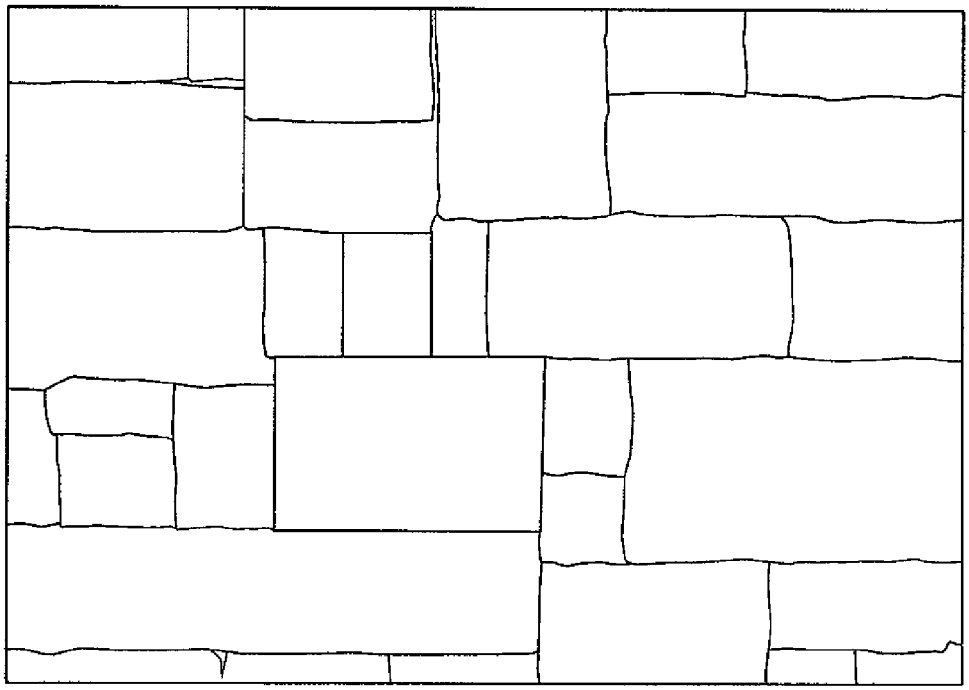
FIGS. 1 & 2 show examples of dry-stacked natural stone walls as known in the art.
Figure 2:
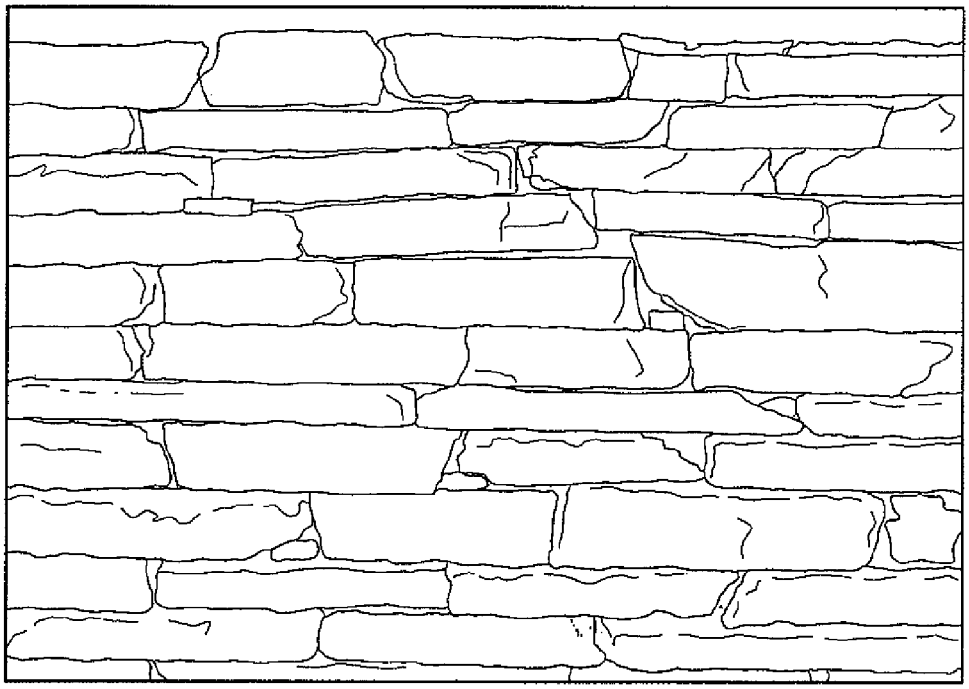
Figure 11:
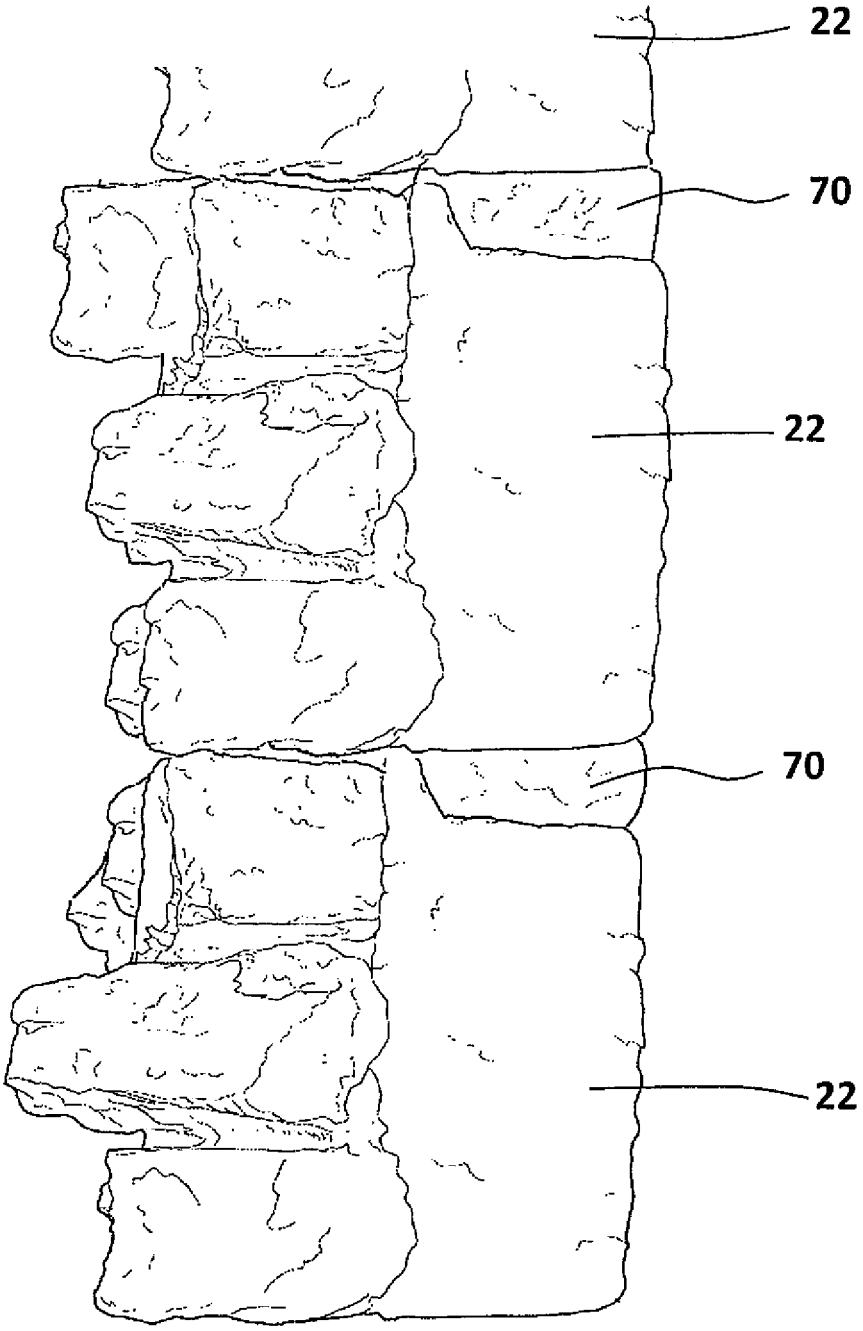
FIG. 11 shows a side view of two manufactured stone blocks secured to each other with mortar in a recess in an upper surface of one of the manufactured stone blocks.

In use when building a wall, manufactured stone blocks are stacked upon each other. A first layer of multiple blocks 22 are laid side by side to form a base layer. This base layer is typically placed adjacent an unfinished wall of a structure, such as a house, with the front face 39 of the blocks facing outwardly from the structure. However, in certain embodiments, the wall may be formed independently and free-standing without any relationship to any other structure. Next, mortar is placed into the hidden mortar joint 48. Thereafter, a second layer of blocks 22 is laid on top of the first layer of blocks with a portion of the bottom face 44 of the second layer of blocks resting substantially directly on the unrecessed portion 52 of the upper face 42 of the first layer of blocks. Substantially the remaining portion of the bottom face of the second layer of blocks rests on the mortar placed in the hidden mortar joint 48, thereby, upon curing of the mortar, providing a mechanism for holding together the layers of manufactured stone block. FIG. 11 shows an exemplary side view of two blocks 22 laid on top of each other with mortar 70 therebetween disposed in a recessed portion of the upper surface of the bottom block. Any number of such blocks 22 could be used to make a finished structure. This process may be repeated until a wall of desired height is built. FIG. 2 shows an example of the appearance of a finished wall built with the manufactured stone blocks 22.

Figure 10:
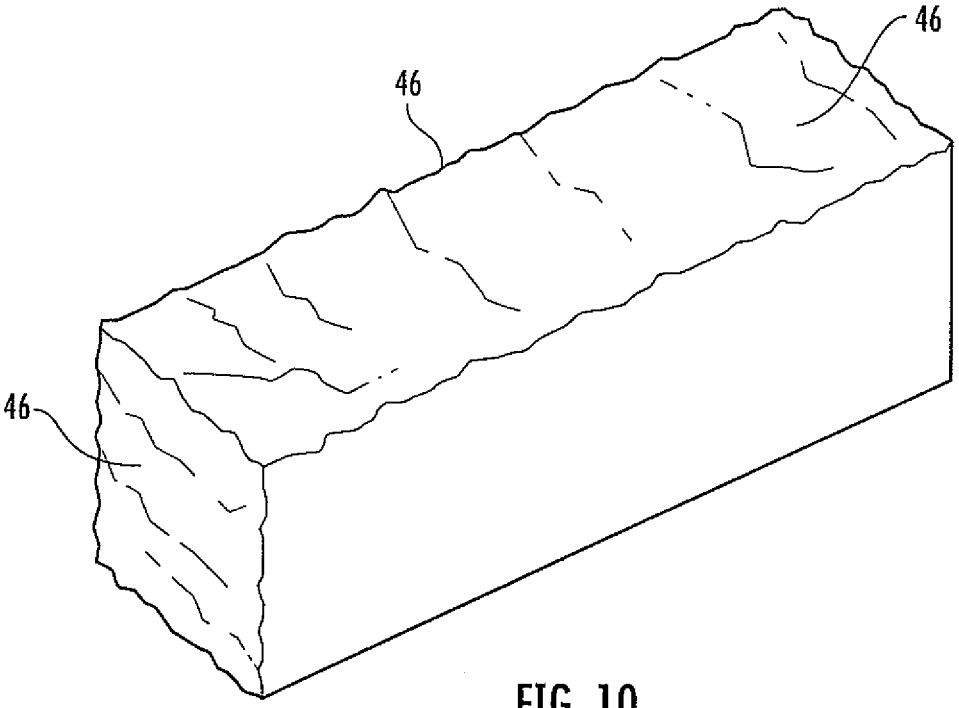
FIG. 10 shows manufactured stone block used for the top surface of a wall according to an embodiment of the invention.

In certain embodiments, it may desirable to fill and compress the head joints to provide extra strength. In such embodiments, compatible colored mortar should be used as the mortar may be partially visible, especially if hidden mortar joints are not included on side faces of the blocks. If desired or needed due to codes, wall ties and weep holes can be used similar to a brick-constructed wall. In certain structures where the top surface of the wall will be visible, it may be necessary to use a block as shown in FIG. 10, which does not include a hidden mortar joint or only includes such a joint on the bottom face. Such a block may have molded stone features on the entire upper face 42 to provide the appearance of a natural stone wall when viewed from the top.

The manufactured stone blocks with hidden mortar joints allow a wall to be built with strength similar to full bed masonry. However, since the mortar joint is not substantially visible on the front face 39 of the manufactured stone block 22, a structure constructed from the manufactured stone blocks of the present invention will provide the appearance of a dry-stack wall, with limited grout visible to an observer of the external portion of the structure. Additionally, the manufactured stone blocks may be used by a mason to build a structure using building methods substantially similar to methods used in building structures with bricks with visible mortar joints using a trowel and other typical equipment, rather than forcing the mason to learn new building methods.

The foregoing description of embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as is suited to the particular use contemplated. All such modifications and variations are within the scope of the invention as determined by the appended claims when interpreted in accordance with the breadth to which they are fairly, legally, and equitably entitled.

What is claimed is:

1. A structure comprising a plurality of solid, unitary molded blocks of monolithic construction, said blocks having an overall generally parallelepiped configuration, wherein at least a portion of said blocks are generally defined by an imaginary parallelepiped projected on to each respective block of the portion of said blocks, each imaginary parallelepiped defined by an overall perimeter of each of the respective blocks and extending directly from adjacent a front surface of each respective block to adjacent a back surface of each respective block and wherein a recess extends from adjacent the back surface of each respective block along an upper surface to a mid-section of the upper surface and the recess extends continuously along a length of each respective block from a first side surface to a second side surface to provide space for mortar to secure at least one respective molded block to an adjacent block, and further wherein mortar is disposed within the recess to secure the at least one respective block to a bottom surface of an adjacent block placed adjacent the at least one respective block such that a front portion of the upper surface of the at least one respective block extending from the front surface to the mid-section of the upper surface is resting on and in direct contact with a front portion of the bottom surface of the adjacent block when the structure is built and a back portion of the bottom surface of the adjacent block is in contact with the mortar.

2. The structure of claim 1, wherein the front surfaces of each respective block have a simulated natural stone appearance.

3. The structure of claim 1, wherein the recesses are not visible from an exterior of the structure.

4. The structure of claim 1, wherein mortar placed within the recesses is substantially not visible from an exterior of the structure.

5. A structure with at least one corner comprising a plurality of solid, unitary manufactured stone blocks of monolithic construction, each manufactured stone blocks having an overall generally parallelepiped configuration and at least a front surface having a simulated natural stone appearance, wherein each of the blocks are generally defined by a respective imaginary parallelepiped projected onto each respective block, each imaginary parallelepiped generally defined by an overall perimeter of each of the respective blocks extending directly from adjacent the front surface of each respective block to adjacent a back surface of each respective block and wherein a portion of a surface of each respective block adjacent an upper surface of each respective imaginary parallelepiped comprises a respective recessed mortar joint which does not extend from adjacent the upper surface of the respective block to the bottom surface of the respective block, wherein the mortar joint is recessed from the respective imaginary parallelepiped a horizontal and vertical depth and length to provide space for mortar to secure the respective block to an adjacent block, wherein mortar is disposed within the recessed mortar joint to secure the respective block to the adjacent block, such that an unrecessed portion of the upper surface of the respective block comprising the recessed mortar joint is in direct contact with a first portion of a lower surface of the adjacent block when the structure is built and a second portion of the lower surface of the adjacent block is in direct contact with the mortar, and further wherein a portion of the plurality of manufactured stone blocks comprise corner blocks disposed adjacent the corner of the structure, the corner blocks having a simulated natural stone appearance on the front surface and a first side surface and wherein the unrecessed portion of the upper surface of the corner blocks extends along an entire length of the front surface and the first side surface and the recessed mortar joint of the corner blocks does not extend to the first side surface, and a portion of the plurality of manufactured stone blocks comprise central blocks which are not disposed adjacent the corner of a structure, the central blocks having the recessed mortar joint extending continuously along an entire length of the back surface from a first side face to a second side face.

6. The structure of claim 5, wherein multiple molded stone features define front surfaces of the blocks wherein the molded features simulate the appearance of projecting portions of the surfaces of natural stones.

7. The structure of claim 5, wherein the recessed mortar joint in at least a portion of the manufactured stone blocks extends from a mid-section of the upper surface of the respective block to the back surface of the respective block.

8. The structure of claim 5, wherein the recessed mortar joint extends down substantially perpendicular from the upper surface of each respective block a distance of from about ¼ inch to about ½ inch and extends from the back surface of each respective block to the mid-section of each respective block a distance from about 2 inches to about 3 inches.

9. The structure of claim 8, wherein the upper surface of each respective block has a depth from the front surface to the back surface of each respective block of about 4 inches.

10. The structure of claim 5, wherein the recessed mortar joint in at least a portion of the manufactured stone blocks slopes downwardly from the mid-section. of the upper surface towards the back surface.

11. The structure of claim 5, wherein a portion of the manufactured stone blocks are molded from an aggregate or crushed stone mixture.

12. The structure of claim 5, wherein a bottom surface of the at least a portion of the manufactured stone blocks also includes a recess.

13. The structure of claim 5, wherein the manufactured stone blocks are dimensionally compatible with standard bricks.

14. A method for building a structure comprising the steps of:

a) providing a plurality of solid, unitary molded blocks of monolithic construction, said blocks having an overall generally parallelepiped configuration, wherein at least a portion of said blocks are generally defined by an imaginary parallelepiped projected on to each respective block of the portion of said blocks, each imaginary parallelepiped defined by an overall perimeter of each of the respective blocks and extending directly from adjacent a front surface of each respective block to adjacent a back surface of each respective block and wherein a recess extends from adjacent the back surface of each respective block along an upper surface to a mid-section of the upper surface and the recess extends continuously along a length of each respective block from a first side surface to a second side surface to provide space for mortar to secure at least one respective molded block to an adjacent block;

b) laying a base layer of the molded blocks on a ground or other substantially flat surface;

c) applying mortar to the recesses on the upper surfaces of the molded blocks in the base layer, but not applying mortar to a front portion of the upper surfaces of the molded blocks in the base layer;

d) after the mortar is applied to the recesses of the molded blocks in the base layer, laying a second layer of molded blocks on the base layer such that a front portion of respective bottom surfaces of the second layer of blocks is resting on and in direct contact with the front portion of the upper surface of the blocks in the base layer and a back portion of the bottom surface of the blocks in the second layer is in contact with the mortar; and e) allowing the mortar to cure such that the blocks in the base layer are substantially adhered to the blocks in the second layer.

* * * * *